United States Patent [19]

Korver

[11] Patent Number: 4,938,277

[45] Date of Patent: Jul. 3, 1990

[54] CASTING MOLD WITH EXPANSION MEMBER FOR RADIATION PLATES

[76] Inventor: Clayton P. Korver, 700 Juneau S.E., Orange City, Iowa 51041

[21] Appl. No.: 281,350

[22] Filed: Dec. 8, 1988

[51] Int. Cl.[5] ..... B22D 15/00

[52] U.S. Cl. ..... 164/137; 164/341; 164/342; 249/82

[58] Field of Search ..... 164/137, 339, 341, 342; 249/82, 166

[56] References Cited

U.S. PATENT DOCUMENTS

| | | | |
|---|---|---|---|
| 3,570,583 | 3/1971 | Lauener | 164/486 |
| 3,570,585 | 3/1971 | Harris | 164/245 |
| 3,671,007 | 6/1972 | Bailey | 249/114 |
| 4,143,852 | 3/1979 | Wiener | 249/135 |
| 4,717,115 | 1/1988 | Schmitz | 249/112 |
| 4,723,750 | 2/1988 | Clark, III | 164/341 |

OTHER PUBLICATIONS

Siemens Photograph Showing Largest Rubber Ring.

*Primary Examiner*—Richard K. Seidel
*Attorney, Agent, or Firm*—Richards, Medlock & Andrews

[57] ABSTRACT

An apparatus and method is provided for producing castings from low melting point alloys which expand upon hardening for use in radiation treatment. An apparatus (10) is provided with a resilient ring (22). As the alloy expands in cooling, the resilient ring deforms outwardly to accommodate the expansion. The molding apparatus (10) can then be disassembled to remove the hardened plate with little risk of harm to the plate.

8 Claims, 1 Drawing Sheet

CASTING MOLD WITH EXPANSION MEMBER FOR RADIATION PLATES

BACKGROUND OF THE INVENTION

When is used to treat cancer, particularly tumors, it is critical to protect surrounding healthy tissue from the radiation to the extent possible. This is often accomplished by shielding the patient from the radiation source with lead alloy plates or shields having irregularly shaped openings which simulates precisely the size and shape of the tumor so that the only radiation permitted through the shield falls on the tumor. The lead alloy shield thus protects healthy tissue around the treated area. These shields are custom cast for each individual based on the size, shape and location of the tumor. The shields are individually cast using a molding process employing a low melting temperature alloy. A pattern of styrofoam is cut into the tumor shape. This pattern is then placed in the mold, and the molten metal is poured around it. The metal is then permitted to cool and harden to form the shield.

One of the unique characteristics of the low temperature alloy is that it expands slightly as it solidifies. Therefore, it is difficult to remove the casting, once cooled, from a fixed mold due to this expansion.

Due to the extreme importance of radiation therapy shields, a need exists for a method and mechanism that eliminates the problems associated with the casting process, including the difficulty of removing castings from the mold.

SUMMARY OF THE INVENTION

The method and mechanism for improving the casting of radiation therapy shields employs a base plate with blocking members along each side. There is further included a resilient, square ring of silicon rubber, which can withstand the temperature of the melted metal with minimum distortion. Additionally, the mechanism includes a top plate with a center opening. This top plate attaches to the bottom plate with screws and thumb nuts, wing nuts or other quick release mechanisms such as C-clamps, a press, or even simple weights. The two plates are separated by the rubber ring which, in turn, is confined within the blocking members. The thumb nuts are fastened to screws which extend from the base plate through the top plate. The thumb nuts are tightened to force the resilient silicon ring downward to seal against the base plate to prevent leakage of the liquid metal beneath the ring.

A further aspect of the present invention is that the lower surface of the top plate can be machined to form a downward extending lip. This insures that the resilient ring is held in place and compressed properly. Even if the ring is thinner than the blocking members, the downward extending lip can be long enough to reach the resilient ring to hold it in position and seal it against the lower block.

A pattern, fashioned from a piece of styrofoam that has been properly shaped, is placed within the opening in the top plate and ring. The liquid metal is then poured around the pattern within the square enclosure. The metal is allowed to cool and solidify. It is during this solidifying process that the metal begins to expand. The resilient ring permits such expansion. When the metal has cooled and stabilized, the thumb nuts are removed to permit lifting of the top plate and easy removal of the expansion ring. The casting is then free to use.

BRIEF DESCRIPTION OF THE DRAWINGS

For a more complete understanding of the present invention and the further advantages thereof, reference is now made to the following Detailed Description taken in conjunction with the accompanying drawings, wherein.

DETAILED DESCRIPTION

Figure 2:
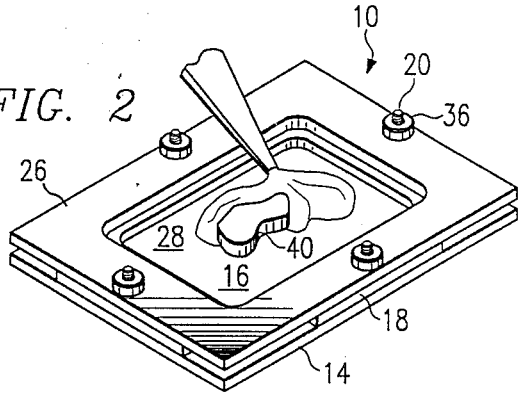
FIG. 2 is an assembled view of the apparatus.
Figure 1:
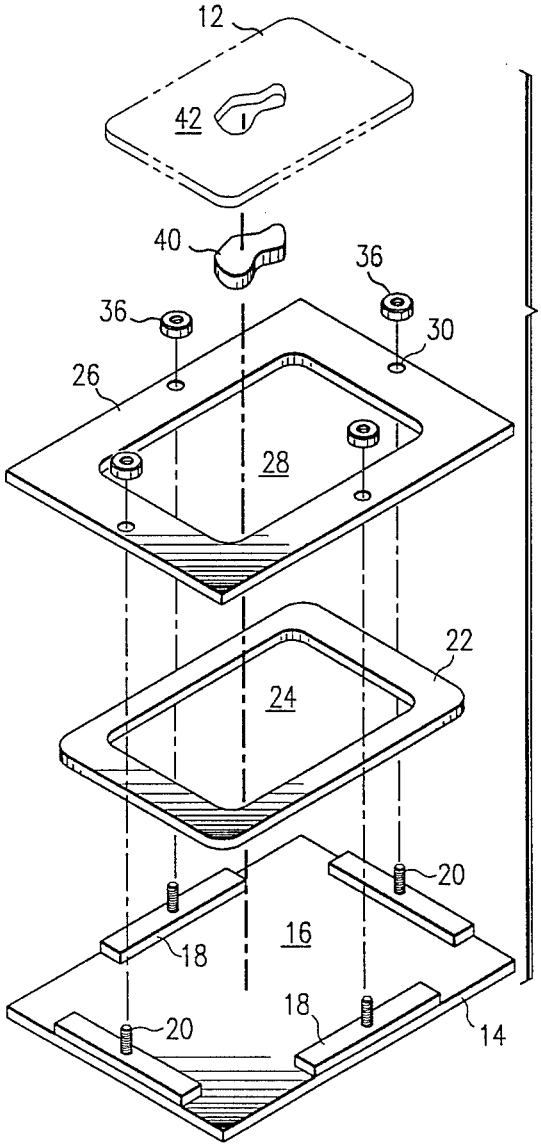
FIG. 1 is an exploded view of a molding apparatus forming a first embodiment of the present invention.
Figure 3:
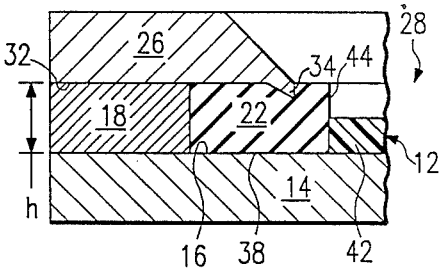
FIG. 3 is a partial cross sectional view of the apparatus illustrating the lip of the top plate extending downwardly into the rubber ring.

With reference now to the FIGURES, wherein like reference numerals designate like or corresponding parts throughout the several views, there is illustrated in FIGS. 1-3 an apparatus 10 forming a first embodiment of the present invention. Apparatus 10 is used to mold custom low temperature alloy plates 12 for use in radiation treatment of tumors in the manner described hereinafter.

As noted previously, the low melting temperature alloys used to make such plates often have a coefficient of expansion which causes the plate to expand slightly as it cools and solidifies from a liquid state to a hard plate at room temperature. One example of such an alloy is a mixture of 50.0% Bismuth, 26.7% lead, 13.3% tin and 10.0% Cadmium. The following is a table of the positive coefficient of expansion for this alloy indicated as inches per inch as determined from cumulative growth measured as the difference in length between mold and test bar dimensions in a test bar 1/2"×1/2"×10×.

| Time After Casting | Growth |
|---|---|
| 2 minutes | +.0025 |
| 6 minutes | +.0027 |
| 30 minutes | +.0045 |
| 1 hour–24 hours | +.0051 |
| 96 hours | +.0053 |
| 200 hours | +.0055 |
| 500 hours | +.0057 |

This particular alloy has a melting temperature of 158° F. The growth after casting of this particular alloy is apparently due to structural changes other than simple thermal expansion or contraction as the coefficient of thermal expansion for this alloy is 0.000022° C., which would indicate the alloy would shrink as it cools to room temperature if only the thermal expansion was present.

The present apparatus accommodates this expansion and provides for easy removal of the hardened plate after cooling and solidifying, eliminating the potential, in the prior art method, for breakage of the alloy plate upon removal from a mold.

The apparatus 10 includes a base plate 14 having a relatively flat upper surface 16. Secured to the upper surface 16 near the edges of plate 14 are a series of blocking members 18. Each blocking member 18 extends a height h above the upper surface 16, as best seen in FIG. 3. From the upper surface of each blocking member 18 extends a threaded stud 20.

A resilient ring 22, preferably formed of a heat resistant rubber, is provided which is placed on the upper surface 16 of plate 14 and confined thereon by the blocking members 18. The ring 22 can be seen to define an opening 24 therethrough having about the dimensions of the lead alloy plate desired. The thickness of the ring 22 preferably is slightly greater than the height h of the blocking members 18.

To complete the apparatus 10, a top plate 26 is provided which has an opening 28 similar in size and dimensions to the opening 24 in resilient ring 22. The top plate 26 is formed with apertures 30 which receive studs 20 to sandwich the resilient ring 22 between plates 14 and 26, as best seen in FIG. 2. With reference to FIG. 3, the lower surface 32 of top plate 26 preferably has a downwardly extending continuous lip 34 which engages the upper surface of the resilient ring 22. Nuts 36 are threaded on to the studs 20 to compress the resilient ring 22 between the plates 14 and 26 to provide an effective seal between the lower surface 38 of the resilient ring 22 and the upper surface 16 of the base plate 14 around the entire periphery of the opening 24. Because the thickness of the resilient ring 22 can not always be carefully controlled, it may be somewhat thicker or thinner than the height h of the blocking members 18. The lip 34 is sized to engage the upper surface of the resilient ring regardless of its actual thickness within the possible thickness tolerances of the ring, and to hold the ring securely against the lower plate.

In use, a pattern 40, shaped to correspond exactly with the tumor to be treated, is placed on the upper surface 16 of plate 14 within openings 24 and 28. Typically, the pattern 40 is made of a low cost material such as styrofoam. The low melting point alloy 42, such as the previously recited alloy having a melting temperature of 158° F., is heated to molten state by a conventional apparatus and poured through opening 28 to fill opening 24. The alloy flows around the pattern 40 and against the inner walls 44 of the resilient ring 22.

As the alloy 42 hardens, it expands due to its coefficient of expansion. This expansion is accommodated by outward deformation of the inner walls 44 of the resilient ring 22. All the expansion of the plate is accommodated by deformation of the resilient ring because the ring is effectively constrained about its outer periphery by blocking members 18 to prevent the ring from expanding outward as the plate solidifies. The engagement of lip 34 with ring 22 further assists this constraint. When the alloy is hardened into the final plate 12, the apparatus is disassembled by removing nuts 36, lifting off top plate 26 and removing the resilient ring 22 from around the alloy plate 12. Because of the resiliency of the ring 22, the disassembly is unlikely to cause any stress on the alloy plate 12 and virtually eliminates the possibility of plate failure so common in prior molding apparatus.

Clearly, the height and thickness of the blocking members 18 and resilient ring 22 can be selected to provide a final thickness of the alloy plate 12 appropriate for the radiation beam being used. Such plates are, for example, commonly about one centimeter thick. Further, while the opening 24 in ring 22 is shown to correspond generally with the size of opening 28 in top plate 26, the size and shape of opening 24 can be selected to achieve the necessary exterior dimension of the alloy plate 12. The exterior dimensions are often used to precisely locate the plate in a mechanism that maintains the plate in proper perspective to the tumor. The present invention permits such precision to be established. Several rings 22 can be provided with the apparatus 10, each having a different opening configuration, to provide flexibility in use of the apparatus 10.

While one embodiment of the present invention has been described in detail herein, and shown in the accompanying drawings, it should be understood that various further modifications and substitutions of parts, materials and elements are possible without departing from the scope and spirit of the invention.

I claim:

1. An apparatus for producing castings, comprising:
a base plate;
a resilient ring having an opening of predetermined shape therein;
blocking members peripherally surrounding said resilient ring;
a top plate having an opening therein which has a shape corresponding to said predetermined shape in said resilient ring; and
means for sandwiching the resilient ring between the top plate and base plate, the blocking members confining the resilient ring on the base plate.

2. The apparatus of claim 1, wherein said blocking members comprise:
a set of partitions which are rigidly fixed to the base plate to hold the ring securely in place.

3. The apparatus of claim 1, wherein said ring comprises:
a resilient material with height similar to the blocking members capable of withstanding a temperature in excess of the melting temperature of the material forming the casting and accommodating expansion of the material as it hardens.

4. An apparatus for producing a radiation shield plate having an aperture of predetermined dimensions represented by a pattern, the plate being formed from a low melting point material which expands during solidification, comprising:
a base plate;
a resilient ring having a first side and an opening of predetermined dimensions capable of receiving the pattern therein;
means for confining the resilient ring;
means for forming a seal between the first side of the resilient ring and the base plate, the pattern being placed within the opening of the resilient ring and on the base plate, molten material poured into the opening about the pattern, the resilient ring deforming as the material hardens to form the shield plate,
a top plate, said forming means compressing the resilient ring between the top plate and base plate to form the seal; and
wherein the top plate has a lower surface, a continuous lip extending from the lower surface toward the resilient ring, the lip providing a uniform compression force to the resilient ring about the entire periphery of the opening to ensure a continuous seal between the resilient ring and the base plate.

5. An apparatus for producing a radiation shield plate having an aperture of predetermined dimensions represented by a pattern, the plate being formed from a low melting point material which expands during solidification, comprising:
a base plate;

a resilient ring having a first side and an opening of predetermined dimensions capable of receiving the pattern therein;

means for confining the resilient ring;

means for forming a seal between the first side of the resilient ring and the base plate, the pattern being placed within the opening of the resilient ring and on the base plate, molten material poured into the opening about the pattern, the resilient ring deforming as the material hardens to form the shield plate, a top plate, said forming means compressing the resilient ring between the top plate and base plate to form the seal;

wherein the top plate has a lower surface, a continuous lip extending from the lower surface toward the resilient ring, the lip providing a uniform compression force to the resilient ring about the entire periphery of the opening to ensure a continuous seal between the resilient ring and the base plate; and wherein the continuous lip forms the means for confining the resilient ring.

6. A method of casting a plate with a low melting temperature alloy which expands upon casting to a hardened condition, comprising the steps of:

placing a resilient ring within blocking members on top of a base plate;

placing a top plate on the ring;

compressing the resilient ring between the top plate and base plate to form a seal between the resilient ring and base plate;

confining the resilient ring to prevent movement of the resilient ring on the base plate;

placing a pattern onto the base plate through an opening in the top plate;

pouring molten alloy through the opening in the top plate;

allowing the alloy to cool and solidify, any expansion in size being accommodated by deformation of the resilient ring;

removing the top plate; and removing the plate from the base plate and from within the resilient ring.

7. An apparatus for producing castings, comprising:

a base plate;

blocking members;

a resilient ring;

a top plate;

means for sandwiching the resilient ring between the top plate and the base plate, the blocking members confining the resilient ring on the base plate, wherein the sandwiching means includes:

screws extending from the base plate through the blocking members and through the top plate; and thumb nuts to tighten the top plate down onto the base plate to sandwich the silicon rubber ring therebetween.

8. An apparatus for producing castings, comprising:

a base plate;

blocking members;

a resilient ring;

a top plate; wherein said top plate comprising a metal plate with an opening in the center and a lip on the bottom side which extends toward the resilient ring; and means for sandwiching the resilient ring between the top plate and the base plate, the blocking members confining the resilient ring on the baseplate.

* * * * *